US009366119B2

(12) United States Patent
Hall et al.

(10) Patent No.: US 9,366,119 B2
(45) Date of Patent: Jun. 14, 2016

(54) DRIVE HEAD FOR A WELLHEAD

(71) Applicant: Brightling Equipment Ltd., Lloydminster (CA)

(72) Inventors: Craig Hall, Lashburn (CA); Derek Tebay, Lloydminster (CA)

(73) Assignee: Brightling Equipment Ltd., Lloydminster, Alberta ( * ) Notice: Subject to any disclaimer, the term of this patent is extended or adjusted under 35 U.S.C. 154(b) by 268 days.

(21) Appl. No.: 13/715,994

(22) Filed: Dec. 14, 2012

(65) Prior Publication Data

US 2014/0166300 A1 Jun. 19, 2014

(51) Int. Cl.
*E21B 43/12* (2006.01)
*E21B 33/08* (2006.01)

(52) U.S. Cl.
CPC ..... *E21B 43/126* (2013.01); *E21B 33/08* (2013.01)

(58) Field of Classification Search
CPC ..... E21B 15/00; E21B 33/00; E21B 43/00
USPC ..... 166/78.1, 75.11
See application file for complete search history.

(56) References Cited

U.S. PATENT DOCUMENTS

| | | | | |
|---|---|---|---|---|
| 2,630,181 | A * | 3/1953 | Solum | 166/78.1 |
| 3,602,300 | A * | 8/1971 | Jaffe | 166/351 |
| 5,383,519 | A * | 1/1995 | Wright | E21B 33/0415 166/104 |
| 6,843,313 | B2 | 1/2005 | Hult | |
| 7,044,217 | B2 | 5/2006 | Hult | |
| 8,662,186 | B2 * | 3/2014 | Robles | 166/372 |
| 2005/0045323 | A1 | 3/2005 | Hult | |
| 2011/0266005 | A1 | 11/2011 | Hult et al. | |

OTHER PUBLICATIONS

Brochure from Monoflo; downloaded from www.nov.com/Artifical-Lift at least as early as Sep. 2012: C-33M Electric Drivehead; 2 pages.
Brochure from Oillift Technology Inc, downloaded from www.oil-lifftechnology.com at least as early as Sep. 2012; Oil Lift H1800; 2 pages.
Oil Lift H1800 Stuffing Box Description, available at least as early as Aug. 2012, 2 pages.
Brochure from Oillift Technology Inc., downloaded from www.oil-lifttechnology.com at least as early as Sep. 2012; Zero Spill Stuffing Box; 1 page.

* cited by examiner

*Primary Examiner* — Brad Harcourt
(74) *Attorney, Agent, or Firm* — Nissen Patent Law; Robert A. Nissen

(57) ABSTRACT

A drive head for a wellhead, the drive head comprising: a rod drive; a pressure chamber; and a rod receiving part connected to the rod drive and enclosed within the pressure chamber. A method comprising: pressurizing a chamber mounted to a wellhead, in which the chamber encloses an upper end of a rod extending from the wellhead; and driving the rod using a rod receiving part enclosed within the chamber.

17 Claims, 5 Drawing Sheets

DRIVE HEAD FOR A WELLHEAD

TECHNICAL FIELD

This document relates to a drive head for a wellhead.

BACKGROUND

Stuffing boxes are used in the oilfield to form a seal between the wellhead and a well tubular passing through the wellhead, in order to prevent leakage of wellbore fluids between the wellhead and the piping. Stuffing boxes may be used in a variety of applications, for example production with pump-jacks, and inserting or removing coiled tubing. Stuffing boxes may incorporate a tubular shaft mounted for rotation in the housing for forming a stationary seal with the piping in order to rotate with the piping. The tubular shaft in turn dynamically seals with the stuffing box housing. Designs of this type of stuffing box can be seen in the following patents: U.S. Pat. No. 7,044,217 and CA 2,350,047. In other designs, the stuffing box may instead form a dynamic seal directly against the piping without incorporating a rotating tubular shaft. Stuffing boxes may be used for rotating or reciprocating pumps.

Drive heads are used in tandem with stuffing boxes. In some cases the drive head sits above the stuffing box. In other cases the stuffing box is incorporated into the drive head or sits above the drive head, for example in FIG. 3 of U.S. Pat. No. 7,044,217.

Leakage of crude oil from a stuffing box is common in some applications, due to a variety of reasons including abrasive particles present in crude oil and poor alignment between the wellhead and stuffing box. Leakage costs oil companies money in service time, down-time and environmental clean-up. Leakage is especially a problem in heavy crude oil wells in which oil may be produced from semi-consolidated sand formations where loose sand is readily transported to the stuffing box by the viscosity of the crude oil. Costs associated with stuffing box failures are some of the highest maintenance costs on many wells.

SUMMARY

A drive head for a wellhead is disclosed, the drive head comprising: a rod drive; a pressure chamber; and a rod receiving part connected to the rod drive and enclosed within the pressure chamber.

A method is disclosed comprising: pressurizing a chamber mounted to a wellhead, in which the chamber encloses an upper end of a rod extending from the wellhead; and driving the rod using a rod receiving part enclosed within the chamber.

A drive head for a wellhead is disclosed, the drive head comprising: a stationary housing with a base, one or more sidewalk, and a top wall; and a rod drive connected to the stationary housing; the stationary housing defining a pressure chamber extending from an opening in the base to the top wall, in which the pressure chamber forms a dead end for a rod.

In various embodiments, there may be included any one or more of the following features: The rod drive is mounted within the pressure chamber. The rod drive is a hydraulic motor. The pressure chamber forms a casing for the hydraulic motor. A case drain is connected between the casing and a hydraulic fluid return line, which is also connected to the hydraulic motor. A rod is connected to the rod receiving part, the rod having an upper end enclosed within the pressure chamber. The pressure chamber is pressurized above a wellhead pressure. The pressure chamber is above 10 psi. The pressure chamber is above 100 psi. At least part of a top wall of the pressure vessel is removable. The rod receiving part further comprises a tubular shaft mounted for rotation, the tubular shaft having a threaded rod end coupler. The drive head is adapted for production of wellbore fluids. The drive head is adapted for a progressing cavity pump application. The rod is connected to a downhole pump. Downhole fluids are produced from the wellhead.

These and other aspects of the device and method are set out in the claims, which are incorporated here by reference.

BRIEF DESCRIPTION OF THE FIGURES

Embodiments will now be described with reference to the figures, in which like reference characters denote like elements, by way of example, and in which.

DETAILED DESCRIPTION

Immaterial modifications may be made to the embodiments described here without departing from what is covered by the claims.

Figures 1A, 1B:
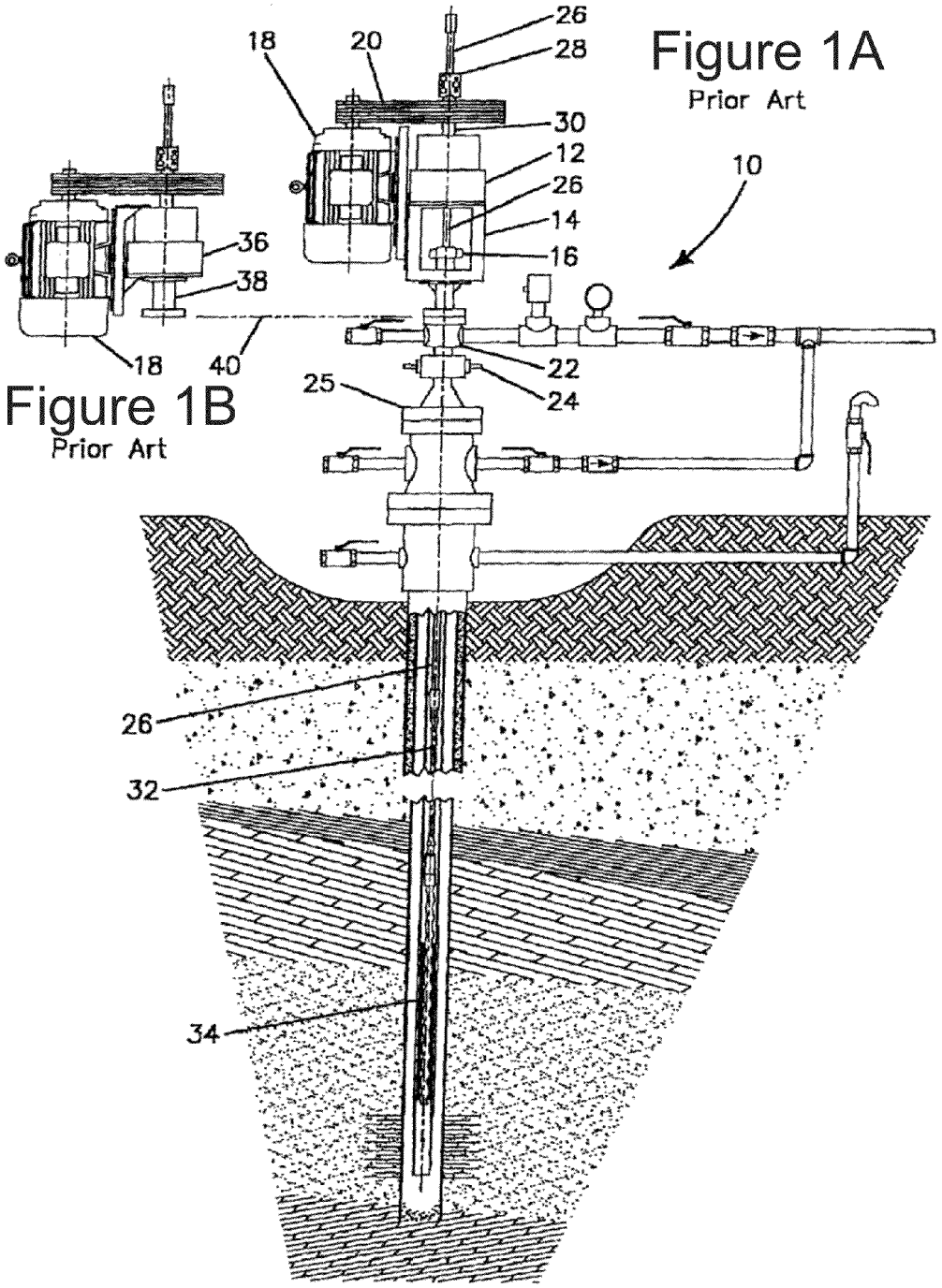
Figure 1A Prior Art
Figure 1B Prior Art
FIG. 1A is a view of a progressing cavity pump oil well installation in an earth formation for production with a typical drive head, wellhead frame and stuffing box.
FIG. 1B is a view similar to the upper end of FIG. 1 but illustrating a conventional drive head with an integrated stuffing box extending from the bottom end of the drive head.

FIG. 1A illustrates a known progressing cavity pump installation 10. The installation 10 includes a typical progressing cavity pump drive head 12, a wellhead frame 14, a stuffing box 16, an electric motor 18, and a belt and sheave drive system 20, all mounted on a flow tee 22. The flow tee is shown with a blowout preventer 24 which is, in turn, mounted on a wellhead 25. The drive head 12 supports and drives a drive shaft 26, generally known as a "polished rod". The polished rod is supported and rotated by means of a polish rod clamp 28, which engages an output shaft 30 of the drive head by means of milled slots (not shown) in both parts. The clamp 28 may prevent the polished rod from falling through the drive head and stuffing box, and may allow the drive head to support the axial weight of the polished rod. Wellhead frame 14 may be open sided in order to expose polished rod 26 to allow a service crew to install a safety clamp on the polished rod and then perform maintenance work on stuffing box 16. Polished rod 26 rotationally drives a drive string 32, sometimes referred to as a sucker rod, which, in turn, drives a progressing cavity pump 34 located at the bottom of the installation to produce well fluids to the surface through the wellhead.

FIG. 1B illustrates a typical progressing cavity pump drive head 36 with an integral stuffing box 38 mounted on the bottom of the drive head and corresponding to the portion of the installation in FIG. 1A that is above the dotted and dashed line 40. An advantage of this type of drive head is that, since the main drive head shaft is already supported with hearings, stuffing box seals can be placed around the main shaft, thus improving alignment and eliminating contact between the stuffing box rotary seals and the polished rod. This style of drive head may also reduce the height of the installation because there is no wellhead frame, and also may reduce cost because there are fewer parts since the stuffing box is integrated with the drive head. A disadvantage is that the drive head must be removed to do maintenance work on the stuffing box. In addition, a stuffing box is still required above the drive head 36 to dynamically seal off the rod 30 from the ambient environment. Surface drive heads for progressing cavity pumps require a stuffing box to seal crude oil from leaking onto the ground where the polished rod passes from the crude oil passage in the wellhead to the drive head.

Figure 2:
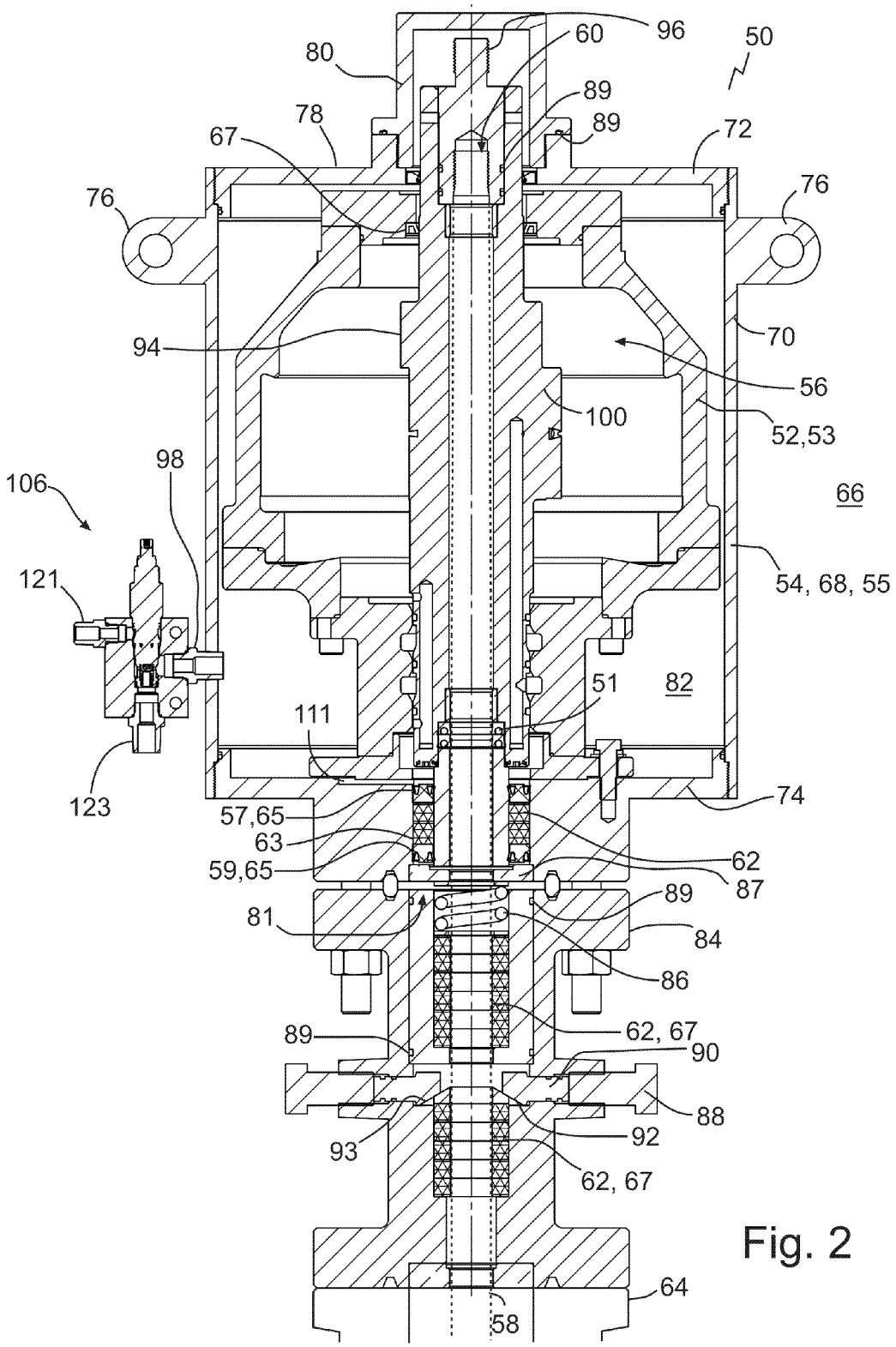
FIG. 2 is a side elevation section view of a drive head for a wellhead.

Referring to FIG. 2, a drive head 50 is illustrated having a rod drive 52, a pressure chamber 54, and a rod receiving part 56. Rod receiving part 56 is connected to the rod drive 52 and enclosed within the pressure chamber 54. A rod 58 may be connected to the rod receiving part 56. In use an upper end 60 of the rod 58 is enclosed within the pressure chamber 54. Thus, the pressure chamber 54 forms a dead end for rod 58. Because part 56 and upper end 60 are enclosed within the pressure chamber 54 during use, there is no need for a dynamic seal, such as provided by a stuffing box, between the rod 58 and the outer ambient environment 66.

The lack of a dynamic seal between the outer ambient environment 66 and the pressure chamber 54 is advantageous because it allows pressure chamber 54 to be pressurized to a much greater extent than if chamber 54 terminated in a dynamic seal to the ambient environment 66 as is the case when a regular stuffing box is used. This is because static seals can be pressurized to a greater extent without leaking than dynamic seals. In fact, pressure chamber 54 may be pressurized above standard case pressures, for example if chamber 54 is pressurized to above 10 psi, above 100 psi, or even as high as above 500 psi in some cases. The pressure of chamber 54 may be equal or lower than pressure line 120 (FIG. 5) pressure if a hydraulic motor 53 is used, described further below. The relatively high pressure of chamber 54 works against wellhead fluid pressure and across the one or more seals 62 between the chamber 54 and the well 64, reducing the amount of wellhead fluids that undesirably cross seals 62 and enter the chamber 54. Chamber 54 may be pressurized above a wellhead pressure. By contrast with dynamic seals of a traditional stuffing box open to atmosphere 66, if bottom seal 59 of drive head 50 fails, pressurized fluid leaks into the well 64 and not into the atmosphere 66.

Figure 4:
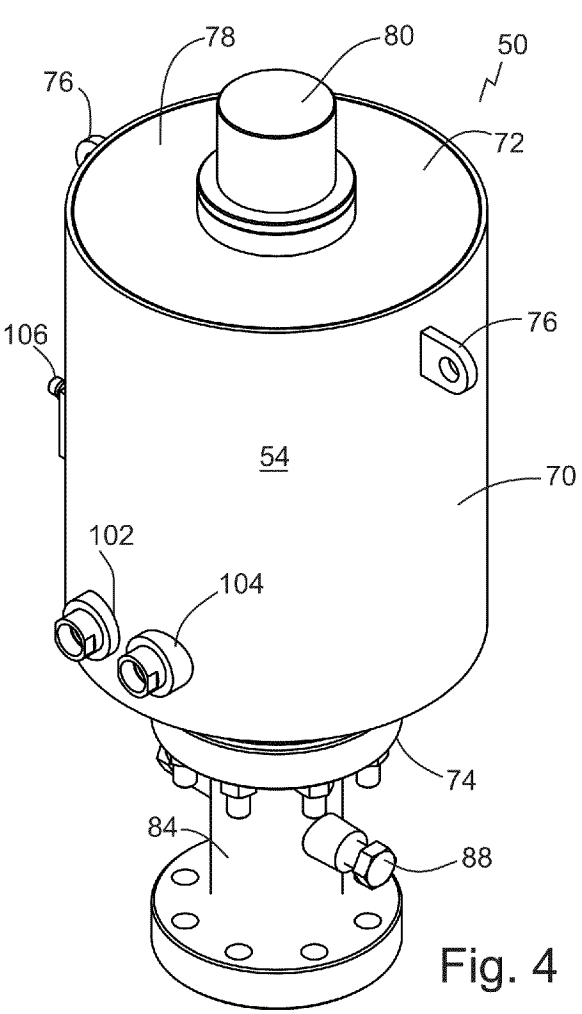
FIG. 4 is a perspective view of the drive head of FIG. 2.
Figure 3:
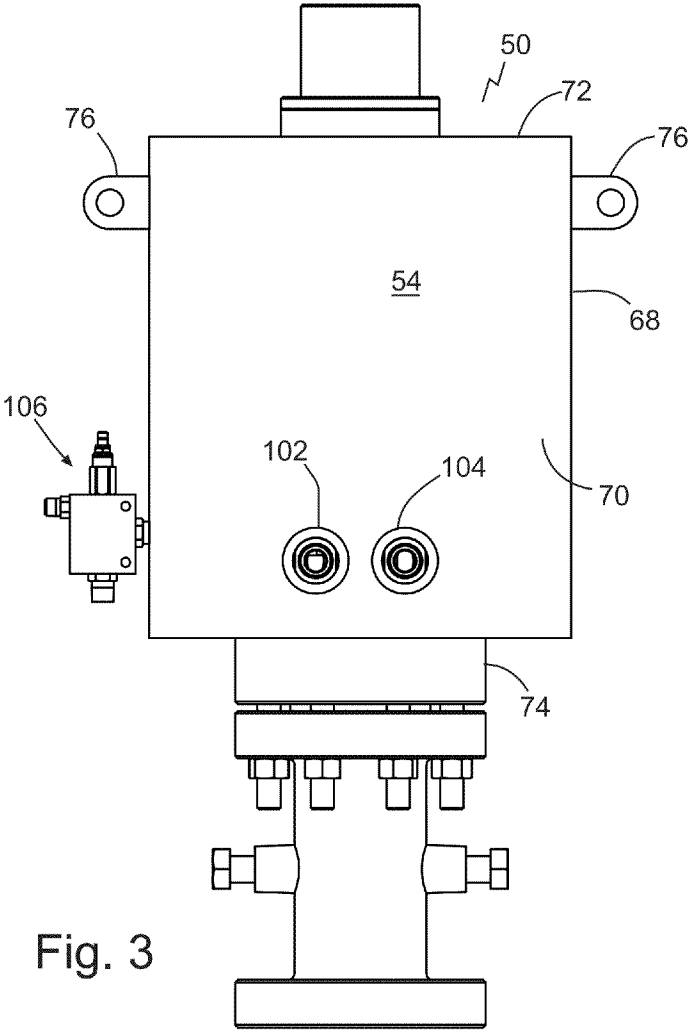
FIG. 3 is a side elevation view of the drive head of FIG. 2.

Referring to FIGS. 2, 3, and 4, chamber 54 may be defined by a stationary housing 68 made up of one or more sidewalk 70, a top wall 72, and a base 74. Sidewall 70 is illustrated as being cylindrical, although other shapes may be used for sidewall 70. Top wall 72 may include an annular top cap 78 connected, for example threaded, to a top hat 80 for enclosing the upper end 60 of the rod 58 (FIG. 2). At least part of top wall 72 may be removable, for example to allow a convenient method of servicing components within the chamber 54. In other cases an interior 82 of chamber 54 is accessible via suitable means, such as a window in sidewall 70. Chamber 54 may include one or more lifting lugs 76 for transporting the drive head 50. Base 74 may house one or more seals 62 for sealing against rod 58 in use. Base 74 may connect to wellhead 64 directly or indirectly as shown, for example through a bottom spool 84. In other cases drive head 50 may be mounted upon a flow tee (not shown). Chamber 54 may extend from an opening 81 in the base 74 to the top wall 72.

The pressurization advantages of chamber 54 are still realized if a stuffing box is used below chamber 54. Bottom spool 84 is a form of stuffing box, although bottom spool 84 does not seal between wellhead fluid and outer ambient environment 66 like a normal stuffing box does. Thus, there is no dynamic seal on spool 84 between environment 66 and wellhead fluid. Bottom spool 84 may include one or more mechanisms for axially compressing seals 62. For example, a biasing device such as spring 86 may be positioned between seals 62 and a ring 87 positioned between spool 84 and base 74. Compression of spring 86 caused by bringing base 74 and spool 84 closer together increases sealing by seals 62 against rod 58. In other cases one or more bolts 88 may be mounted in spool 84 to provide lateral force into a wedge piston 90 whose tapered lateral end 92 contacts a wedge ring 93 that transfers lateral force into axial compression against seals 62. Seals 62 positioned below bottom seals 59 of base 74 are advantageously used with drive head 50 in that they allow servicing of the drive head 50 without allowing leakage of well fluids. To service drive head 50, a user may remove top hat 80, coupler 96, and top wall 72 in some cases, and remove a part or all of motor 53. Poly seals 51 prevent excess production fluids from leaking past and contaminating the pressurized chamber 54.

The rod receiving part 56 may comprise a tubular shaft 94 or rotating sleeve mounted for rotation. The tubular shaft 94 may have a threaded rod end coupler 96, such as a hex driver with a PR thread as shown. One or more bearings or bushings (not shown) may be used to align the shaft 94 and facilitate smooth rotation. Shaft 94 may be connected to be driven by rod drive 52 by a suitable mechanism such as meshing with a lateral extension 100 of shaft 94. Other mechanisms of torque transfer between rod drive 52 and rod 58 may be used.

The rod drive 52 may be connected to the chamber 54, for example mounted within the pressure chamber 54 as shown. The rod drive 52 may be a suitable motor, such as a hydraulic motor 53. The pressure vessel 54 may form a casing 55 for the hydraulic motor 53. A case drain 98 may be connected to the casing 55. Hydraulic pressure and return lines may connect to a pressure line input 102 and a return line input 104 formed in housing 68 (FIGS. 3 and 4). A relief valve 106 may be located on case drain 98 (FIGS. 2-4). One or more fluid channels 111 may extend laterally from for example above top seal 57 of base 74, in order to provide a leak path to allow fluid leaking from hydraulic motor 53 to preferentially collect in casing 55. Fluid channel 111 also prevents crude oil from wellhead 64 from being forced into hydraulic motor 53, where such oil may over pressure and damage motor 53. Case drain 98 pressure may be set at a higher pressure than production fluid, so if hydraulic fluid is lost it goes downhole. If enough hydraulic fluid is lost, motor 53 will shut down.

Figure 5:
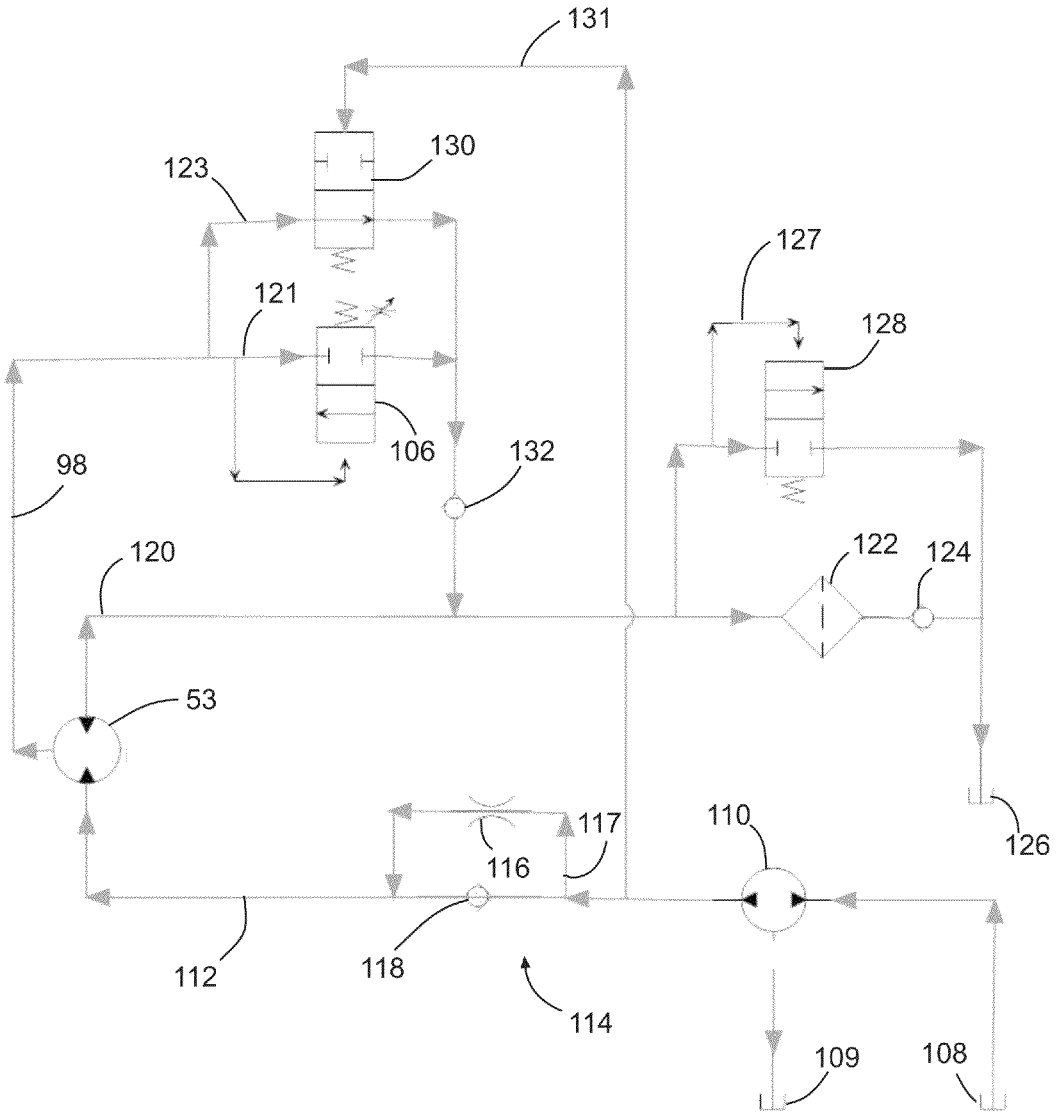
FIG. 5 is a hydraulic fluid schematic for operating the drive head of FIG. 2.

Referring to FIGS. 2, 3, and 5, a method of operation of hydraulic motor 53 will be described. Fluid from one or more hydraulic tanks 108 is pumped via pump 110 through a pressure line 112 (FIG. 5). A return tank 109 may also be connected to pump 110. A retarder 114 with a restriction 116 on bypass loop 117 may be located on line 112 to prevent or reduce backspin upon pump shut off. On pump shut off, the backspin generated by rod 58 and exerted upon motor 53 causes reverse flow of hydraulic fluid in line 112, which cannot pass through check valve 118, and instead flows through restriction 116 at a reduced flow rate, if at all. Restriction 116 acts as a break on backspin, and prevents the rod from damaging itself via unconstrained freewheeling. Restriction 116 also prevents or reduces the chance that hydraulic fluid contaminated with wellhead fluid is sent back to pump 110 or tank 108.

Pressure line 112 (FIG. 5) sends hydraulic fluid to motor 53 through pressure input 102 (FIG. 3), where the pressure of the hydraulic fluid is used to perform work by rotating rod 58

(FIG. 2). Rod 58 may connect to a downhole pump 34 for producing well fluids. Chamber 54 is pressurized by the motor case drain 98, which is choked off via relief valve 106. Once the work is accomplished by a given unit of fluid volume, the unit of fluid volume returns through return input 104 (FIG. 3) and into return line 120 (FIG. 5). Return line 120 cleans contaminants such as sand particles from return fluid by passing return fluid through a filter 122, a check valve 124. After filtration, the return fluid is deposited for re-use or further cleaning in a tank 126, which may be the same as one of tanks 108 or 109 (FIG. 5). If filter 122 becomes clogged, or in other events where fluid pressure in line 120 climbs beyond a predetermined level, a bypass valve 128 controlled by pressure from line 127 of line 120 bypasses return fluid past the filter 122 and into tank 126.

Motor 53 also includes case drain 98 between the casing 55 (FIG. 2) and hydraulic fluid return line 120 (FIG. 5). The case drain line 98 has a line 123 that passes into a valve 130 that feeds case fluid back into return line 120 for recycling and re-use during normal pump 110 operation. Valve 130 is controlled by pressure from line 131 sent from pressure line 112, so that the system operates as shown when pump 110 is not operating. Thus, free flow across valve 130 is allowed until the pressure line 112 pressure builds to a sufficient level to close valve 130. When the pump 110 is shut off or pressure in line 112 reduces below a predetermined pressure, valve 130 opens to allow fluid connection between case drain 98 and return line 120 to reduce case pressure. Thus, during operation, the pressure in chamber 54 is allowed to grow to a predetermined pressure. In the event that valve 130 malfunctions and doesn't open, or another event causes an undesirable pressure increase in line 98 indicating a pressure state in pressure chamber 54 above a predetermined pressure, pressure from line 98 causes relief valve 106 to open, allowing case drain pressure to pass through bypass line 121 of line 98 and into return line 120 through check valve 132. Running the case drain 98 to the return line 120 eliminates the need for an additional hose that would otherwise be used to keep the casing 55 at a low enough pressure to prevent dynamic seal leakage.

Drive head 50 may be used for production of wellbore fluids, such as production in a progressing cavity pumping application as shown. Drive head 50 may be adapted to be retrofitted into a wellhead 39. In other cases drive head 50 may be adapted for an integral application, for example in the style shown in FIG. 1B. Connections between components may be accomplished by suitable mechanisms such as bolting, threading, clamping, and retaining. Although described above for a rotating rod embodiment, drive head 52 may be used in a reciprocating rod application as well.

It should be understood that various other components may be incorporated into drive head 50. For example, various seals 89 may be provided at points between rod 58 and housing 68, or between other components. Similarly, o-rings, gaskets, packing and other components may be used.

Referring to FIG. 2, the one or more seals 62 may comprise packing 63, packing 67, or other suitable seals such as lip seals 65 or poly seals 51. Seals 62 may be mechanical or non-mechanical seals. Different packing may be used for packing 63 and 67. One or more rings such as brass rings may be located on either side of seals 62. O-rings 89 or other suitable gaskets may be used throughout drive head 50. In general, where the word seal is mentioned in this document, one or more seals may be provided to effectively operate as a single seal, for example observed in the stacking of packing seals 65.

Figure 6:
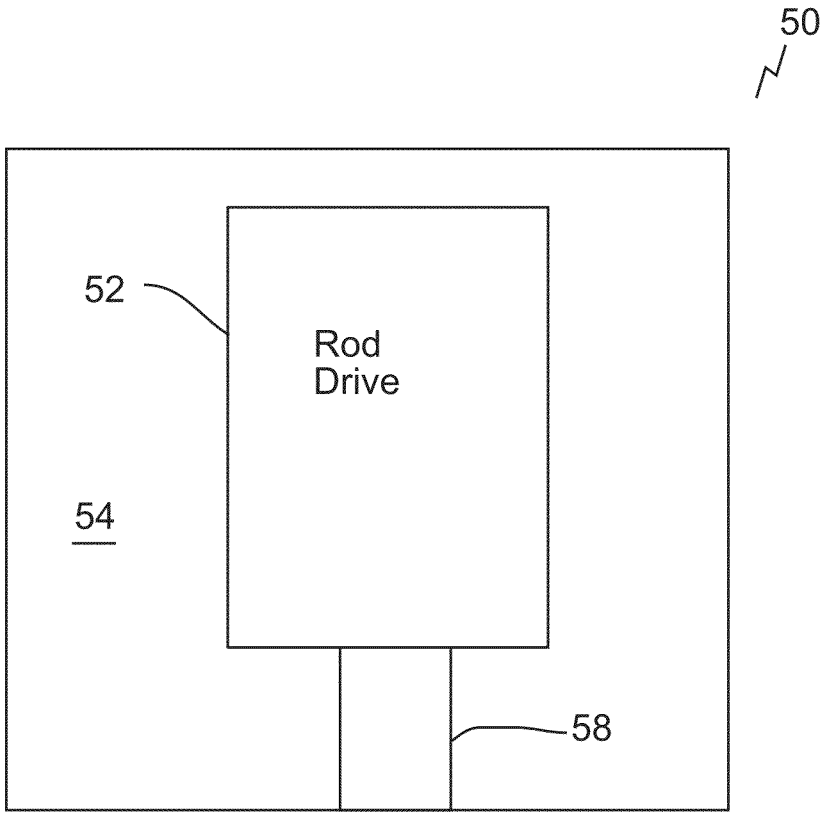
FIG. 6 is a side elevation view of a drive head incorporating an electric rod drive.

It should be understood that various other components such as blow out preventers may be provided with the drive head 50 for wellhead applications to be carried out. Drive head 50 may incorporate a lubrication system (not shown) for lubricating various components, such as the one or more seals 62. Various components discussed herein may include subcomponents, such as the plural sleeves that thread together to make up the top wall 72 of FIG. 2. As well, components that are shown as being separate may be combined integrally, for example base 74 and side wall 70. Connections between components, or the mounting of one component to another, may be done through intermediate parts. Figures may not be drawn to scale, and may have dimensions exaggerated for the purpose of illustration. Drive head 50 may have no rotating parts or dynamic seals on the exterior of drive head 50. Non hydraulic drives may be used, for example if an electric motor is used as shown in FIG. 6, although a pressurization system may be required to pressurize chamber 54.

In the claims, the word "comprising" is used in its inclusive sense and does not exclude other elements being present. The indefinite article "a" before a claim feature does not exclude more than one of the feature being present. Each one of the individual features described here may be used in one or more embodiments and is not, by virtue only of being described here, to be construed as essential to all embodiments as defined by the claims.

The embodiments of the invention in which an exclusive property or privilege is claimed are defined as follows:

1. A drive head for a wellhead, the drive head comprising:
- a rod drive for a downhole pump;
- a pressure chamber defined by interior surfaces of a stationary housing;
- a rod receiving part connected to the rod drive and enclosed within the pressure chamber, in which the rod receiving part comprises a tubular shaft mounted for rotation, the tubular shaft having a threaded rod end coupler; and
- a rod connected to the rod receiving part, the rod forming an upper end of a drive string, and a part of the interior surfaces of the stationary housing extending over the upper end of the drive string to enclose the upper end within the pressure chamber.

2. The drive head of claim 1 in which the rod drive is mounted within the pressure chamber.

3. The drive head of claim 1 in which the rod drive is a hydraulic motor.

4. The drive head of claim 1 in which the rod drive is an electric motor.

5. The drive head of claim 3 in which the pressure chamber forms a casing for the hydraulic motor.

6. The drive head of claim 5 further comprising a case drain connected between the casing and a hydraulic fluid return line, which is also connected to the hydraulic motor.

7. The drive head of claim 1 in which the pressure chamber is pressurized above a wellhead pressure.

8. The drive head of claim 7 in which the pressure chamber is above 10 psi.

9. The drive head of claim 8 in which the pressure chamber is above 100 psi.

10. The drive head of claim 1 in which at least part of a top wall, which is part of the stationary housing and defines part of the pressure chamber, is removable.

11. The drive head of claim 1 adapted for production of wellbore fluids.

12. The drive head of claim 1 adapted for a progressing cavity pump application.

13. A method comprising:

pressurizing a chamber mounted to a wellhead and defined by interior surfaces of a stationary housing, in which a rod extends from the wellhead, the rod forming an upper end of a drive string, and a part of the interior surfaces of the stationary housing extending over the upper end of the drive string to enclose the upper end within the pressure chamber, the rod being connected to a rod receiving part enclosed within the pressure chamber, in which the rod receiving part comprises a tubular shaft mounted for rotation, the tubular shaft having a threaded rod end coupler; and driving the rod, using the rod receiving part, to power a downhole pump.

14. The method of claim 13 in which the rod is driven by a rod drive mounted within the pressure chamber.

15. The method of claim 13 in which the rod is connected to a downhole pump.

16. The method of claim 13 further comprising producing downhole fluids from the wellhead.

17. A drive head for a wellhead, the drive head comprising:

a stationary housing with a base, one or more sidewalls, and a top wall; and a rod drive for a downhole pump, the rod drive being connected to the stationary housing;

a pressure chamber defined by interior surfaces of the stationary housing, the pressure chamber extending from an opening in the base to the top wall, a rod forming an upper end of a drive string, and a part of the interior surfaces of the stationary housing extending over the upper end of the drive string to enclose the upper end within the pressure chamber to form a dead end for the rod, the rod being connected to the rod drive via a rod receiving part enclosed within the chamber, in which the rod receiving part comprises a tubular shaft mounted for rotation, the tubular shaft having a threaded rod end coupler.

* * * * *